US009552763B2

(12) United States Patent
Chun et al.

(10) Patent No.: US 9,552,763 B2
(45) Date of Patent: Jan. 24, 2017

(54) DATA CONVERSION UNIT AND METHOD OF CONVERTING DATA

(71) Applicant: SAMSUNG DISPLAY CO., LTD., Yongin, Gyeonggi-Do (KR)

(72) Inventors: Byung-Ki Chun, Yongin (KR); Yong-Seok Choi, Yongin (KR); Dong-Wook Yang, Yongin (KR)

(73) Assignee: SAMSUNG DISPLAY CO., LTD., Yongin, Gyunggi-do (KR)

( * ) Notice: Subject to any disclaimer, the term of this patent is extended or adjusted under 35 U.S.C. 154(b) by 24 days.

(21) Appl. No.: 14/502,003

(22) Filed: Sep. 30, 2014

(65) Prior Publication Data

US 2015/0097765 A1 Apr. 9, 2015

(30) Foreign Application Priority Data

Oct. 4, 2013 (KR) ..... 10-2013-0118474

(51) Int. Cl.
*G09G 3/32* (2016.01)

(52) U.S. Cl.
CPC .... *G09G 3/3208* (2013.01); *G09G 2320/0271* (2013.01); *G09G 2320/0626* (2013.01); *G09G 2360/16* (2013.01)

(58) Field of Classification Search
None
See application file for complete search history.

(56) References Cited

U.S. PATENT DOCUMENTS

2004/0233125 A1* 11/2004 Tanghe ..... G06F 3/1446 345/1.3
2009/0251494 A1* 10/2009 Shi ..... G09G 3/20 345/690
2011/0187754 A1 8/2011 Yoo
2012/0032998 A1* 2/2012 An ..... G09G 3/3696 345/690
2012/0242719 A1* 9/2012 Klompenhouwer . G09G 3/2074 345/690
2012/0287143 A1 11/2012 Brown Elliott
(Continued)

FOREIGN PATENT DOCUMENTS

KR 10-2006-0114131 A 11/2006
KR 10-2011-0090303 A 8/2011
(Continued)

*Primary Examiner* — Amr Awad
*Assistant Examiner* — Donna Lui
(74) *Attorney, Agent, or Firm* — Lee & Morse P.C.

(57) ABSTRACT

A data conversion unit includes a gamma conversion unit configured to generate a first gamma data by gamma-converting a first data supplied from an outside thereof, a representative luminance value calculation unit configured to calculate a representative luminance value of an entire panel, based on the first gamma data, a subtraction unit configured to subtract the calculated representative luminance value from gamma conversion values of respective pixels included in the first gamma data, a compensation unit configured to generate a second gamma data by converting the gamma conversion values of the respective pixels, based on the subtracted values corresponding to the respective pixels, and an inverse gamma conversion unit configured to generate a second data by inverse-gamma-converting the second gamma data.

14 Claims, 3 Drawing Sheets

(56) References Cited

U.S. PATENT DOCUMENTS

| | | | | |
|---|---|---|---|---|
| 2012/0306947 | A1 | 12/2012 | Kim et al. | |
| 2014/0152714 | A1* | 6/2014 | Nakagawa | H04N 9/67 345/690 |
| 2014/0253421 | A1* | 9/2014 | Izumi | G09G 3/36 345/87 |

FOREIGN PATENT DOCUMENTS

| | | | |
|---|---|---|---|
| KR | 10-2012-0127211 | A | 11/2012 |
| KR | 10-2012-0134201 | A | 12/2012 |

* cited by examiner

DATA CONVERSION UNIT AND METHOD OF CONVERTING DATA

CROSS-REFERENCE TO RELATED APPLICATION

Korean Patent Application No. 10-2013-0118474, filed on Oct. 4, 2013, in the Korean Intellectual Property Office, and entitled: "Data Conversion Unit and Method of Converting Data," is incorporated by reference herein in its entirety.

BACKGROUND

1. Field

An aspect of embodiments relates to a data conversion unit and a method of converting data.

2. Description of the Related Art

Recently, there have been developed various types of flat panel displays capable of reducing the weight and volume of cathode ray tubes, which are disadvantages. Such flat panel displays may include, e.g., a liquid crystal display, a field emission display, a plasma display panel, an organic light emitting display, and the like.

Among these flat panel displays, the organic light emitting display displays images using organic light emitting diodes (OLEDs) that emit light through recombination of electrons and holes. The organic light emitting display has a fast response speed and is driven with low power consumption. In a general organic light emitting display, a driving transistor included in each pixel supplies current with amplitude corresponding to a data signal, so that light is generated in an organic light emitting diode.

SUMMARY

Embodiments provide a data conversion unit and a method of converting data, which can reduce a load effect while maintaining color coordinates.

According to embodiments, there is provided a data conversion unit, including a gamma conversion unit configured to generate a first gamma data by gamma-converting a first data supplied from an outside thereof, a representative luminance value calculation unit configured to calculate a representative luminance value of an entire panel, based on the first gamma data, a subtraction unit configured to subtract the calculated representative luminance value from gamma conversion values of respective pixels included in the first gamma data, a compensation unit configured to generate a second gamma data by converting the gamma conversion values of the respective pixels, based on the subtracted values corresponding to the respective pixels, and an inverse gamma conversion unit configured to generate a second data by inverse-gamma-converting the second gamma data.

The representative luminance value calculation unit may generate, as the representative luminance value, the average value of the gamma conversion values of the respective pixels.

The representative luminance value calculation unit may generate, as the representative luminance value, the value obtained by multiplying the gamma conversion values of the respective pixels by weights corresponding to colors of the respective pixels and then averaging the multiplied gamma conversion values.

The compensation unit may convert the gamma conversion values, in inverse proportion to the subtraction values.

The compensation unit may decrease the gamma conversion values when the subtraction values have positive values, and increase the gamma conversion values when the subtraction values have negative values.

The compensation unit may calculate the gamma conversion values by multiplying proportional constants, based on the colors of the respective pixels.

The proportional constants may be determined, based on a material constituting an organic light emitting diode.

The proportional constants may be determined, based on the amplitude of current supplied to the organic light emitting diode.

According to other embodiments, there is provided a method of converting data, including generating a first gamma data by gamma-converting a first data supplied from an outside, calculating a representative luminance value of an entire panel, based on the first gamma data, subtracting the representative luminance value from gamma conversion values of respective pixels included in the first gamma data, generating a second gamma data by converting the gamma conversion values of the respective pixels, based on subtraction values corresponding to the respective pixels, and generating a second data by inverse-gamma-converting the second gamma data.

The representative luminance value may be the average value of the gamma conversion values.

The representative luminance value may be the average value of the values obtained by multiplying the gamma conversion values of the respective pixels by weights corresponding to colors of the respective pixels.

The generating of the second gamma data may include converting the gamma conversion values of the respective pixels, in inverse proportion to the subtraction values corresponding to the respective pixels.

The generating of the second gamma data may include may further include multiplying the converted gamma conversion values by proportional constants, based on the colors of the respective pixels.

The proportional constants may be determined, based on a material constituting an organic light emitting diode.

The proportional constants may be determined, based on the amplitude of current supplied to the organic light emitting diode.

BRIEF DESCRIPTION OF THE DRAWINGS

Features will become apparent to those of ordinary skill in the art by describing in detail exemplary embodiments with reference to the attached drawings, in which.

DETAILED DESCRIPTION

Figure 1:
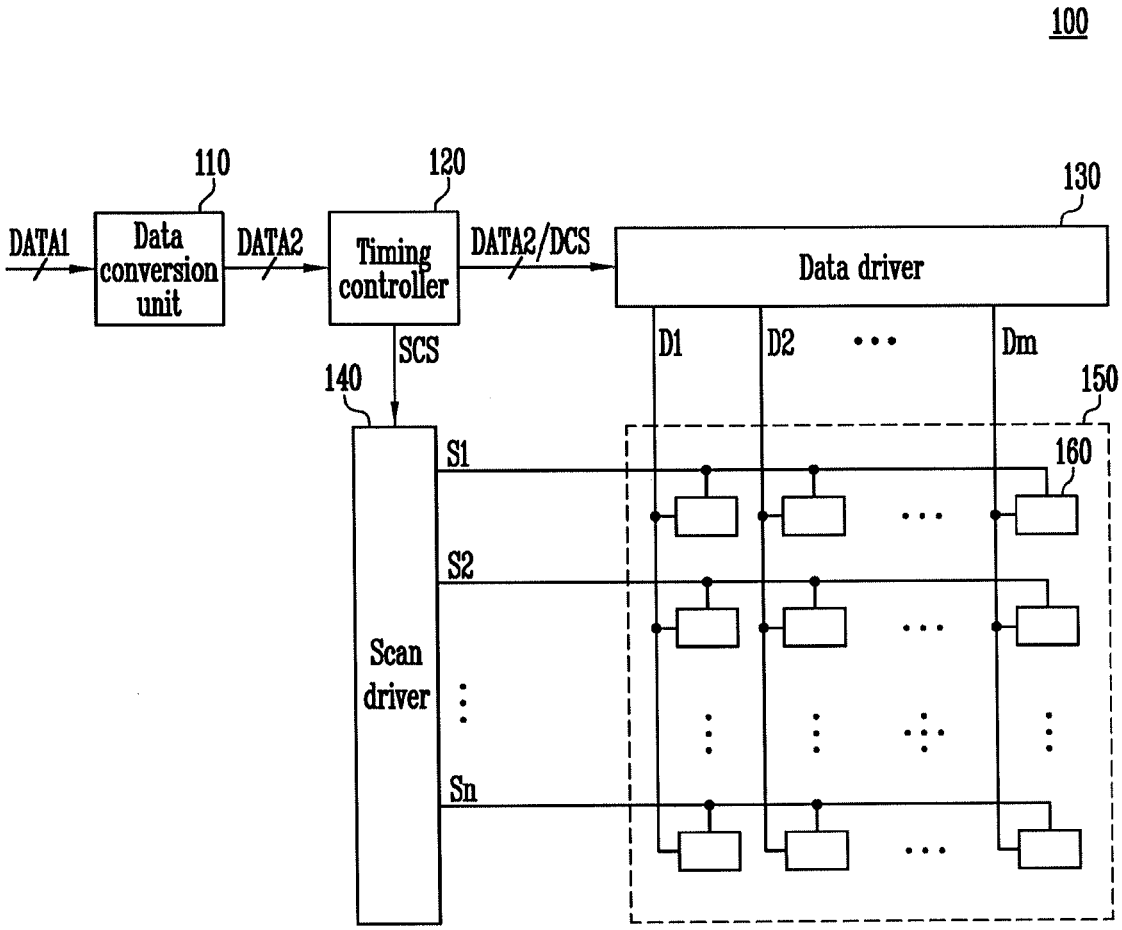
FIG. 1 illustrates a block diagram of an organic light emitting display according to an embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

FIG. 1 illustrates a block diagram of an organic light emitting display according to an embodiment.

Referring to FIG. 1, an organic light emitting display 100 may include a data conversion unit 110, a timing controller 120, a data driver 130, a scan driver 140, and a display unit 150.

The data conversion unit 110 converts a first data DATA1 supplied from an outside thereof into a second data DATA2, and supplies the converted second data DATA2 to the data driver 130.

In detail, the data conversion unit 110 calculates a representative luminance value RLV of an image to be displayed by a display panel, i.e., the entire display unit 150, during one frame. Further, the data conversion unit 110 converts the first data DATA1 into the second data DATA2, based on the calculated representative luminance value RLV, so pixels 160 emit light corresponding to the second data DATA2. That is, the data conversion unit 110 adjusts luminance values of the respective pixels 160 included in the first data DATA1, based on differences between the luminance values of the respective pixels 160 and the representative luminance value RLV, thereby generating the second data DATA2. Accordingly, the pixels 160 display an exact image which is not influenced by the load effect, thereby realizing a display with a reduced load effect while maintaining color coordinates of respective pixels 160.

The function and operation of the data conversion unit 110 will be described in detail with reference to FIG. 2.

The timing controller 120 controls operations of the data driver 130 and the scan driver 140, in response to a synchronization signal (not shown) supplied from an outside thereof. Specifically, the timing controller 120 generates a data driving control signal DCS and supplies the generated data driving control signal DCS to the data driver 130. The timing controller 120 generates a scan driving control signal SCS and supplies the generated scan driving control signal SCS to the scan driver 140. Further, the timing controller 120 supplies, to the data driver 130, the second data DATA2 supplied from the data conversion unit 110.

Although the data conversion unit 110 and the timing controller 120 have been separately illustrated in FIG. 1, embodiments are not limited thereto. For example, the data conversion unit 110 and the timing controller 120 may be implemented with one circuit.

The data driver 130 realigns the second data DATA2 supplied from the timing controller 120, in response to the data driving control signal DCS output from the timing controller 120, and supplies the realigned second data DATA2 as data signals to data lines D1 to Dm.

The scan driver 140 progressively supplies a scan signal to scan lines S1 to Sn, in response to the scan driving control signal SCS output from the timing controller 120.

The display unit 150 includes pixels 160 respectively disposed at intersection portions of the data lines D1 to Dm and the scan lines S1 to Sn. For example, the data lines D1 to Dm may be arranged along vertical lines, and the scan lines S1 to Sn may be arranged along horizontal lines.

Each pixel 160 emits light with luminance corresponding to a data signal supplied through a corresponding data line among the data lines D1 to Dm when a scan signal is supplied through a corresponding scan line among the scan lines S1 to Sn. Each pixel 160 emits light of any one color of red, green and blue.

Figure 2:
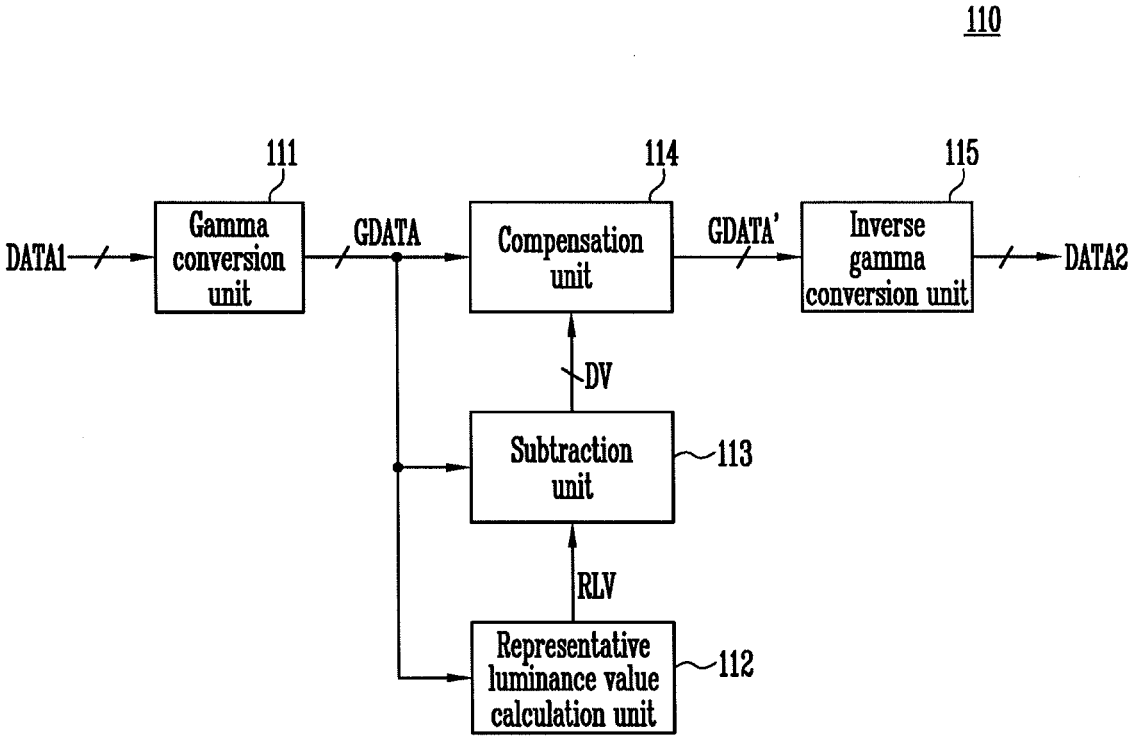
FIG. 2 illustrates a detailed block diagram of a data conversion unit shown in FIG. 1.

FIG. 2 illustrates a detailed block diagram of the data conversion unit 110. Referring to FIGS. 1 and 2, the data conversion unit 110 may include a gamma conversion unit 111, a representative luminance value calculation unit 112, a subtraction unit 113, a compensation unit 114, and an inverse gamma conversion unit 115.

The gamma conversion unit 111 generates a first gamma data GDATA by gamma-converting the first data DATA1 output from an outside thereof. In detail, the gamma conversion unit 111 converts the first data DATA1 into the first gamma data GDATA through an exponential function using the gamma value of the first data DATA1 as an exponent. For example, when the gamma value of the first data DATA1 is 2.2, gamma conversion values corresponding to the respective pixels 160 are generated as shown in the following Equation 1.

$$GTV=(GV/255)^{2.2} \quad \text{Equation 1}$$

In Equation 1, GV denotes a gray scale value corresponding to each pixel 160 included in the first data DATA1, and GTV denotes a gamma conversion value corresponding to each pixel 160 included in the first gamma data GDATA.

The gamma conversion unit 111 supplies the first gamma data GDATA to the representative luminance value calculation unit 112, the subtraction unit 113, and the compensation unit 114.

The representative luminance value calculation unit 112 calculates the representative luminance value RLV of an image to be displayed by the entire panel, i.e., the display unit 150, based on the first gamma data GDATA supplied from the gamma conversion unit 111.

According to an embodiment, the representative luminance value calculation unit 112 may generate the representative luminance value RLV as the average value of gamma conversion values included in the first gamma data GDATA. That is, the representative luminance value RLV may be the average value of the gamma conversion values.

According to another embodiment, the representative luminance value calculation unit 112 may generate the representative luminance value RLV as the value obtained by multiplying gamma conversion values included in the first gamma data GDATA by weights corresponding to the colors of the respective pixels 160 and then averaging the multiplied gamma conversion values. That is, the representative luminance value RLV may be the average value of the values obtained by multiplying the gamma conversion values by the weights corresponding to the colors of the respective pixels 160. For example, the representative luminance value calculation unit 112 may generate the representative luminance value RLV as shown in the following Equation 2.

$$RLV = \frac{1}{N}\sum_{all}(WVr \times GTVr + WVg \times GTVg + WVb \times GTVb) \quad \text{Equation 2}$$

In Equation 2, N denotes the number of all the pixels. WVr denotes a weight corresponding to red pixels, WVg denotes a weight corresponding to green pixels, and WVb denotes a weight corresponding to blue pixels. In addition, GTVr denotes a gamma conversion value of each red pixel, GTVg denotes a gamma conversion value of each green pixel, and GTVb denotes a gamma conversion value of each blue pixel.

The representative luminance value calculation unit 112 supplies the representative luminance value RLV to the subtraction unit 113.

The subtraction unit 113 subtracts the representative luminance value RLV from the gamma conversion values corresponding to the respective pixels 160 included in the first gamma data GDATA. For example, the subtraction unit 113 may generate subtraction values DV corresponding to the respective pixels 160 as shown in the following Equation 3.

$$DV=GTV-RLV \quad \text{Equation 3}$$

The subtraction unit 113 supplies, to the compensation unit 114, the subtraction values DV corresponding to the respective pixels 160.

The compensation unit 114 converts the first gamma data GDATA into a second gamma data GDATA', in response to the subtraction values DV supplied from the subtraction unit 113. In detail, the compensation unit 114 converts the gamma conversion values of the respective pixels 160, based on the subtraction values DV corresponding to the respective pixels 160.

The compensation unit 114 converts the gamma conversion values GTV in inverse proportion to the subtraction values DV. That is, the compensation unit 114 adjusts the sizes of the gamma conversion values GTV as much as the absolute values of the subtraction values DV become large. On the contrary, the compensation unit 114 adjusts the sizes of the gamma conversion values GTV as little as the absolute values of the subtraction values DV become small. The compensation unit 114 decreases the gamma conversion values GTV when the subtraction values DV have positive values, and increases the gamma conversion values GTV when the subtraction values DV have negative values.

The compensation unit 114 converts the gamma conversion values GTV by multiplying different proportional constants, based on the colors of the respective pixels 160. The different proportional constants may be experimentally determined. As an example, the different proportional constants may be determined, based on a material constituting an organic light emitting diode. As another example, the different proportional constants may be determined, based on the amplitude of current flowing through the organic light emitting diode.

In other words, the compensation unit 114 may convert the gamma conversion values GTV as shown in the following Equations 4 to 6.

$$GTVr'=GTVr\times(1-PCr\times DVr) \quad \text{Equation 4}$$

In Equation 4, GTVr' denotes a value obtained by converting the gamma conversion value corresponding to each red pixel, GTVr denotes a gamma conversion value corresponding to each red pixel, PCr denotes a proportional constant corresponding to the red pixels, and DVr denotes a subtraction value corresponding to each red pixel.

$$GTVg'=GTVg\times(1-PCg\times DVg) \quad \text{Equation 5}$$

In Equation 5, GTVg' denotes a value obtained by converting the gamma conversion value corresponding to each green pixel, GTVg denotes a gamma conversion value corresponding to each green pixel, PCg denotes a proportional constant corresponding to the green pixels, and DVg denotes a subtraction value corresponding to each green pixel.

$$GTVb'=GTVb\times(1-PCb\times DVb) \quad \text{Equation 6}$$

In Equation 6, GTVb' denotes a value obtained by converting the gamma conversion value corresponding to each blue pixel, GTVb denotes a gamma conversion value corresponding to each blue pixel, PCb denotes a proportional constant corresponding to the blue pixels, and DVb denotes a subtraction value corresponding to each blue pixel.

The compensation unit 114 supplies, to the inverse gamma conversion unit 115, the second gamma data GDATA' including the converted gamma conversion values GTVr', GTVg' and GTVb'.

The inverse gamma conversion unit 115 generates the second data DATA2 by inverse-gamma-converting the second gamma data GDATA' supplied from the compensation unit 114. In detail, the inverse gamma conversion unit 115 converts the second gamma data GDATA' into the second data DATA2 through an exponential function using the reciprocal of the gamma value of the first data DATA1 as an exponent. For example, when the gamma value of the first data DATA1 is 2.2, the values corresponding to the respective pixels 160 are generated as shown in the following Equation 7.

$$GV'=(GTV')^{2.2}\times 255 \quad \text{Equation 7}$$

In Equation 7, GV' denotes gray scale values converted corresponding to the respective pixels 160, and GTV' denotes gamma conversion values GTVr', GTVg' and GTVb' converted corresponding to the respective pixels 160.

The inverse gamma conversion unit 115 supplies the second data DATA2 to the data driver 130.

Figure 3:
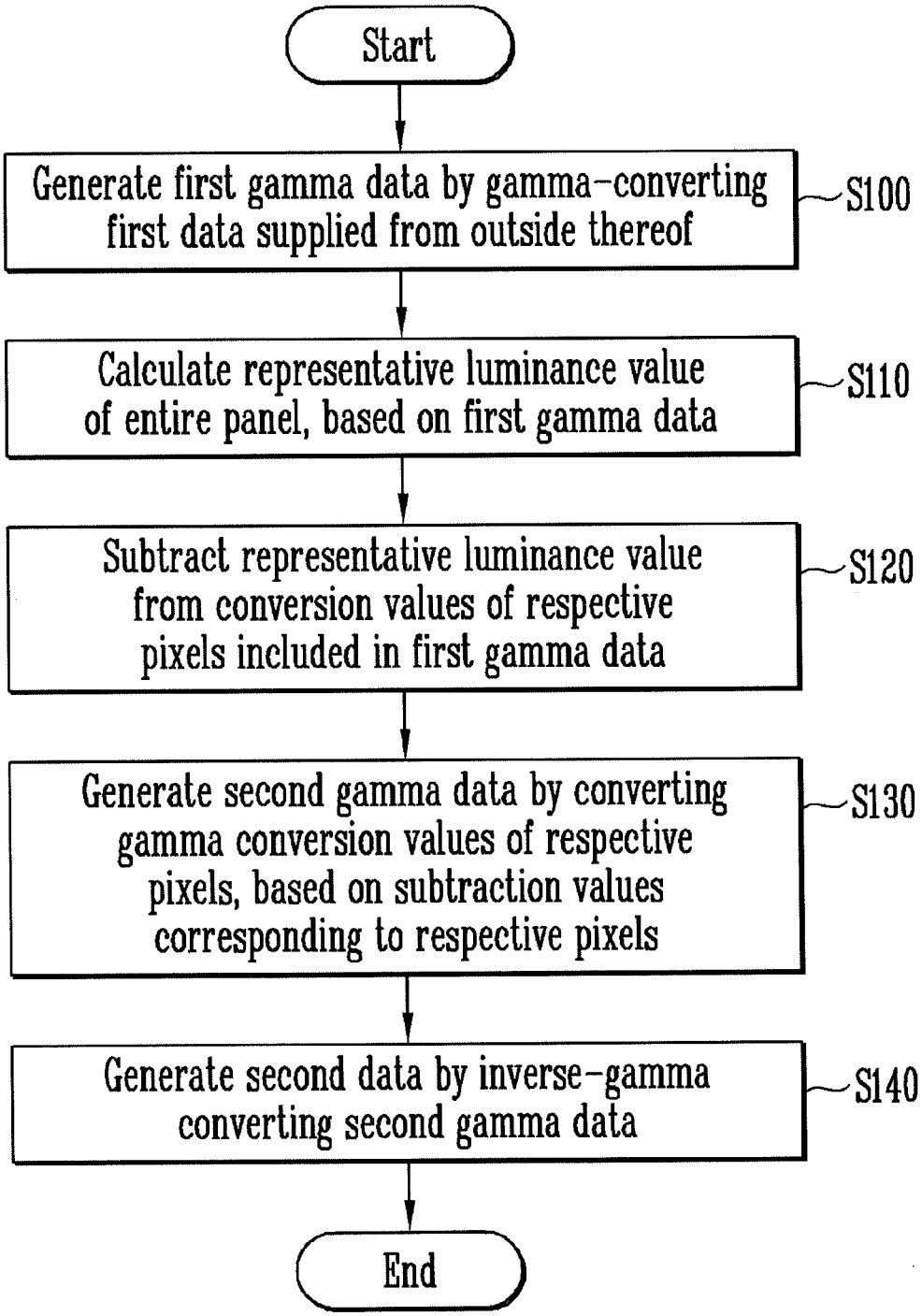
FIG. 3 illustrates a flowchart of a method of converting data according to an embodiment.

FIG. 3 illustrates a flowchart of a method of converting data according to an embodiment.

Referring to FIGS. 1 to 3, the data conversion unit 110 generates the first gamma data GDATA by gamma-converting the first data DATA1 supplied from an outside thereof. In detail, the gamma conversion unit 111 gamma-converts gray scale values corresponding to the respective pixels 160 included in the first data DATA1, and generates the first gamma data GDATA including gamma conversion values (S100).

The data conversion unit 110 calculates the representative luminance value RLV of the entire panel, based on the first gamma data GDATA. In detail, the representative luminance value calculation unit 112 generates the representative luminance value RLV by averaging or weight-averaging the gamma conversion values included in the first gamma data GDATA (S110).

The data conversion unit 110 subtracts the representative luminance value RLV from the gamma conversion values of the respective pixels 160 included in the first gamma data GDATA (S120).

The data conversion unit 110 generates the second gamma data GDATA' by converting the gamma conversion values of the respective pixels, based on subtraction values corresponding to the respective pixels 160 (S130).

The data conversion unit 110 generates the second data DATA2 by inverse-gamma-converting the second gamma data GDATA' (S140).

Through the aforementioned process, the data conversion unit 110 can generate the second data DATA2 which can reduce a load effect while maintaining color coordinates.

The data driver 130 supplies the second data DATA2 generated by the data conversion unit 110 to the pixels 160 through the data lines D1 to Dm.

The pixels 160 emit light, corresponding to the second data DATA2, thereby displaying an exact image which is not influenced by the load effect.

The equations described in this specification are provided to illustrate the technical spirit of the embodiments, but the embodiments are not limited thereto. That is, the equations described in this specification may be variously modified.

By way of summation and review, in an organic light emitting display, there occurs a load effect that when light is emitted with bright luminance, a load is increased, and luminance is decreased. Since each pixel does not emit light with exact luminance corresponding to a data signal, the image quality may be deteriorated. In contrast, in the data conversion unit and the method of converting data according to embodiments, it is possible to reduce the load effect while maintaining color coordinates.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A data conversion unit, comprising:

a gamma converter to generate gamma conversion values of a first gamma data by gamma-converting a first data supplied from an outside thereof, the gamma conversion values corresponding to respective pixels;

a representative luminance value calculator to calculate a representative luminance value of an entire panel, based on the gamma conversion values of the first gamma data, wherein the representative luminance value calculator generates, as the representative luminance value, a value obtained by multiplying the gamma conversion values of the respective pixels by weights corresponding to colors of the respective pixels, and by averaging the multiplied gamma conversion values;

a subtractor to generate subtraction values by subtracting the calculated representative luminance value from the gamma conversion values of the first gamma data corresponding to the respective pixels;

a compensator to generate a second gamma data by converting the gamma conversion values of the first gamma data corresponding to the respective pixels, based on the subtraction values corresponding to the respective pixels; and an inverse gamma converter to generate a second data by inverse-gamma-converting the second gamma data.

2. The data conversion unit as claimed in claim 1, wherein the representative luminance value calculator generates, as the representative luminance value, an average value of the gamma conversion values of the respective pixels.

3. The data conversion unit as claimed in claim 1, wherein the compensator converts the gamma conversion values, in inverse proportion to the subtraction values.

4. The data conversion unit as claimed in claim 3, wherein the compensator decreases the gamma conversion values when the subtraction values have positive values, and increases the gamma conversion values when the subtraction values have negative values.

5. The data conversion unit as claimed in claim 4, wherein the compensator calculates the gamma conversion values by multiplying proportional constants, based on the colors of the respective pixels.

6. The data conversion unit as claimed in claim 5, wherein the proportional constants are determined, based on a material constituting an organic light emitting diode.

7. The data conversion unit as claimed in claim 5, wherein the proportional constants are determined, based on an amplitude of a current supplied to the organic light emitting diode.

8. The data conversion unit as claimed in claim 1, wherein the gamma conversion values of the first gamma data are generated by gamma-converting the first data using a gamma value of the first data.

9. A method of converting data, the method comprising:

generating gamma conversion values of a first gamma data by gamma-converting a first data supplied from an outside, the gamma conversion values corresponding to respective pixels;

calculating a representative luminance value of an entire panel, based on the gamma conversion values of the first gamma data corresponding to the respective pixels, wherein the representative luminance value is an average value of the values obtained by multiplying the gamma conversion values of the respective pixels by weights corresponding to colors of the respective pixels;

generating subtraction values by subtracting the representative luminance value from the gamma conversion values of the first gamma data corresponding to the respective pixels included in the first gamma data;

generating a second gamma data by converting the gamma conversion values of the first gamma data corresponding to the respective pixels, based on the subtraction values corresponding to the respective pixels; and generating a second data by inverse-gamma-converting the second gamma data.

10. The method as claimed in claim 9, wherein the representative luminance value is an average value of the gamma conversion values.

11. The method as claimed in claim 9, wherein generating the second gamma data includes converting the gamma conversion values of the respective pixels, in inverse proportion to the subtraction values corresponding to the respective pixels.

12. The method as claimed in claim 11, wherein generating the second gamma data further includes multiplying the converted gamma conversion values by proportional constants, based on the colors of the respective pixels.

13. The method as claimed in claim 12, wherein the proportional constants are determined, based on a material constituting an organic light emitting diode.

14. The method as claimed in claim 12, wherein the proportional constants are determined, based on an amplitude of a current supplied to the organic light emitting diode.

* * * * *